US006959494B2

(12) United States Patent
Taylor

(10) Patent No.: US 6,959,494 B2
(45) Date of Patent: Nov. 1, 2005

(54) FOLDING BLADE KNIFE WITH SPRING ASSISTED PIVOTING FEATURE

(75) Inventor: William J. Taylor, Marietta, GA (US)

(73) Assignee: Camillus Cutlery Company, Camillus, NY (US)

( * ) Notice: Subject to any disclaimer, the term of this patent is extended or adjusted under 35 U.S.C. 154(b) by 164 days.

(21) Appl. No.: 10/680,751

(22) Filed: Oct. 7, 2003

(65) Prior Publication Data

US 2005/0072005 A1 Apr. 7, 2005

(51) Int. Cl.[7] ..... B26B 1/04
(52) U.S. Cl. ..... 30/159; 30/160
(58) Field of Search ..... 30/158–161

(56) References Cited

U.S. PATENT DOCUMENTS

| | | | |
|---|---|---|---|
| 23,975 | A | 5/1859 | Belcher |
| 226,910 | A | 4/1880 | Friebertschauser |
| 338,251 | A | 5/1886 | Crandall et al. |
| 530,792 | A | 12/1894 | Nordlow |
| 551,052 | A | 12/1895 | Shonnard et al. |
| 557,760 | A | 4/1896 | Brauer |
| 600,442 | A | 3/1898 | Nell |
| 749,230 | A | 1/1904 | Severence |
| 969,909 | A | 9/1910 | Schrade et al. |
| 1,454,665 | A | 5/1923 | Bobek |
| 1,584,165 | A | 5/1926 | Brown |
| 1,701,027 | A | 2/1929 | Brown |
| 1,743,022 | A | 1/1930 | Carman |
| 1,810,031 | A | 6/1931 | Schrade |
| 1,864,011 | A | 6/1932 | Brown |
| 4,347,665 | A | 9/1982 | Glesser |
| 4,404,748 | A | 9/1983 | Wiethoff |
| 4,451,982 | A | 6/1984 | Collins |
| 4,502,221 | A | 3/1985 | Pittman |
| 4,719,700 | A | 1/1988 | Taylor, Jr. |
| 4,805,303 | A | 2/1989 | Gibbs |
| 4,811,486 | A | 3/1989 | Cunningham |
| 4,837,932 | A | 6/1989 | Elsener |
| 4,896,424 | A | 1/1990 | Walker |
| 4,974,323 | A | 12/1990 | Cassady |
| 4,979,301 | A | 12/1990 | Walker |

(Continued)

FOREIGN PATENT DOCUMENTS

| | | |
|---|---|---|
| DE | 1104386 | 1/1960 |

(Continued)

*Primary Examiner*—Douglas D Watts
(74) *Attorney, Agent, or Firm*—George R. McGuire; Bond,Schoeneck & King PLLC

(57) ABSTRACT

A folding knife having a blade and integral tang pivotally mounted to a handle with a cantilever spring fixedly attached at one end to the handle and extending to a free, terminal end having a lobed portion. A camming member fixed to the tang has a camming surface spaced from the pivot axis extending through the tang. The lobed portion of the spring contacts the camming surface when the blade is in the fully closed position and remains in contact throughout a first portion of the blade movement toward the open position. The spring is out of contact with the camming surface during a second portion of blade movement, from the end of the first portion to the fully open position. Momentum developed by spring force applied to the camming member during the first portion of blade movement is sufficient to move the blade through the second portion of its movement to the fully open position. Cooperative stop portions on the tang and handle define the limits of blade movement to fully open and closed positions, and resiliently lock the blade in the fully open position.

20 Claims, 7 Drawing Sheets

U.S. PATENT DOCUMENTS

| | | | | |
|---|---|---|---|---|
| 5,044,079 | A | 9/1991 | Gibbs | |
| 5,060,379 | A | 10/1991 | Neely | |
| 5,095,624 | A | 3/1992 | Ennis | |
| 5,111,581 | A | 5/1992 | Collins | |
| 5,293,690 | A | 3/1994 | Cassady | |
| 5,331,741 | A | 7/1994 | Taylor, Jr. | |
| 5,400,509 | A | 3/1995 | Collins | |
| 5,437,101 | A | 8/1995 | Collins | |
| D365,266 | S | 12/1995 | Hasegawa | |
| 5,502,895 | A | 4/1996 | Lemaire | |
| 5,515,610 | A | 5/1996 | Levin et al. | |
| 5,537,750 | A | 7/1996 | Seber et al. | |
| 5,689,885 | A | 11/1997 | Walston | |
| 5,692,304 | A | 12/1997 | Campbell | |
| 5,737,841 | A | 4/1998 | McHenry et al. | |
| 5,755,035 | A | 5/1998 | Weatherly | |
| 5,802,722 | A | 9/1998 | Maxey et al. | |
| 5,815,927 | A | 10/1998 | Collins | |
| 5,819,414 | A | 10/1998 | Marifone | |
| 5,822,866 | A | 10/1998 | Pardue | |
| 5,826,340 | A | 10/1998 | Hull | |
| 5,887,347 | A | 3/1999 | Gibbs | |
| 5,915,792 | A | 6/1999 | Sakurai | |
| 5,964,035 | A | 10/1999 | Poehlmann | |
| 5,964,036 | A | 10/1999 | Centofante | |
| 6,079,106 | A | 6/2000 | Vallotton | |
| 6,145,202 | A | 11/2000 | Onion | |
| 6,154,965 | A | 12/2000 | Sakai | |
| 6,308,420 | B1 * | 10/2001 | Moser | 30/161 |
| 6,338,431 | B1 | 1/2002 | Onion | |
| 6,363,615 | B1 | 4/2002 | Moser | |
| 6,370,778 | B1 | 4/2002 | Conable | |
| 6,397,476 | B1 | 6/2002 | Onion | |
| 6,397,477 | B1 | 6/2002 | Collins | |
| 6,427,334 | B2 | 8/2002 | Onion | |
| 6,732,436 | B2 * | 5/2004 | Moizis | 30/155 |
| 2003/0140500 | A1 | 7/2003 | Cheng | |

FOREIGN PATENT DOCUMENTS

| | | |
|---|---|---|
| FR | 1069862 | 2/1954 |
| FR | 1248117 | 10/1960 |
| JP | 52-60500 | 5/1977 |

* cited by examiner

FOLDING BLADE KNIFE WITH SPRING ASSISTED PIVOTING FEATURE

BACKGROUND OF THE INVENTION

The present invention relates to folding blade knives and, more particularly, to knives having one or more blades pivotally movable between open and closed positions with respect to a handle piece with biasing means assisting in such movement.

The prior art includes many examples of folding knives wherein a blade is pivotally mounted upon a handle piece for movement for movement between open and closed positions with a spring, wire, or other biasing means assisting in such movement. In one type of spring assisted blade opening, typified by U.S. Pat. Nos. 6,145,202, 6,397,476, 5,802,722, and 6,308,420, the blade must be moved manually away from the fully open or fully closed position for a portion of its travel before the biasing element takes effect to complete the blade movement. The biasing element may be in the form of a wire having opposite end portions bent to extend through openings or grooves in the handle and blade, or have a portion engaging a roller mounted upon the blade tang with a central axis parallel to and spaced from the pivot axis of the blade.

In general, the object of the present invention is to provide a novel and improved folding blade knife having a spring for assisting in pivotal movement of the blade through terminal portions of its travel between the open and closed positions.

A further object is to provide a knife having a blade pivotally mounted upon a handle piece for movement between fully open and closed positions wherein the blade is moved manually for an initial portion of its travel from one position toward the other and is then moved by spring action for the remainder of such travel, wherein the knife incorporates novel and improved biasing means providing the assisted blade movement.

Another object is to provide a folding blade knife having a cantilever spring and cam mechanism for assisting blade movement from partly to fully open and closed positions.

Other objects will partly be obvious and will partly appear hereinafter.

SUMMARY OF THE INVENTION

In furtherance of the foregoing objects, the present invention contemplates a knife having a handle portion with a blade pivotally connected thereto for movement between a fully closed position, wherein a portion of the blade including the cutting edge is received between two spaced handle portions, and a fully open position, wherein the blade extends substantially coaxially from the handle. The blade has a sharp point at one end and a tang portion at the other end, with a post defining the axis of rotation of the blade extending through a hole in the tang portion and secured at opposite ends to the spaced handle portions. A cantilever spring is firmly anchored at a fixed end to one of the handle portions within a recess which faces the other handle portion. The spring extends through this recess to a free end having a laterally extending lobe positioned adjacent, but spaced from, the post about which the blade is pivoted. This lobe engages a cam member extending laterally from the tang when the blade is in the closed position and remains in contact with the cam throughout a portion of the blade travel toward the open position. The surface of the cam member which is engaged by the end portion of the spring has a predetermined size and shape such that the spring exerts a biasing force retaining the blade in the closed position, and, after manual movement of the blade away from the fully closed position for a first portion of its travel, the spring acts upon the cam surface to move the blade through a second portion of its travel toward the fully open position. The momentum developed by spring movement results in inertial movement of the blade through a third portion of its travel to the fully open position wherein it is locked by automatically actuated locking means. Upon manual release of the locking means, the blade may be manually rotated from the fully open to the fully closed position, with the spring acting upon the cam surface over a terminal portion of such movement to assist in moving the blade to, and retaining it in, the fully closed position.

The foregoing and other features of construction and operation of the folding blade knife of the invention will be more readily understood and fully appreciated from the following detailed disclosure, taken in conjunction with the accompanying drawings, wherein:

DETAILED DESCRIPTION

Figure 1:
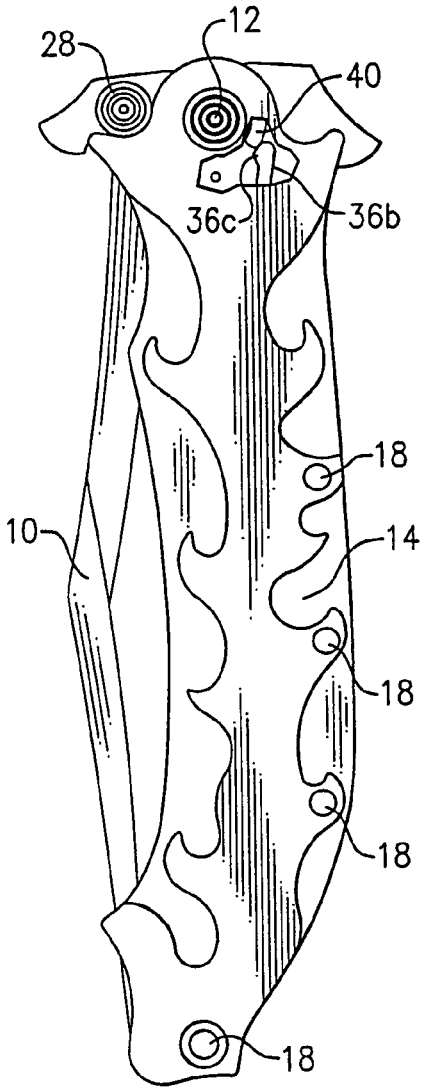
FIG. 1 is a fragmentary side view of the folding blade knife in the fully closed position.
Figure 8:
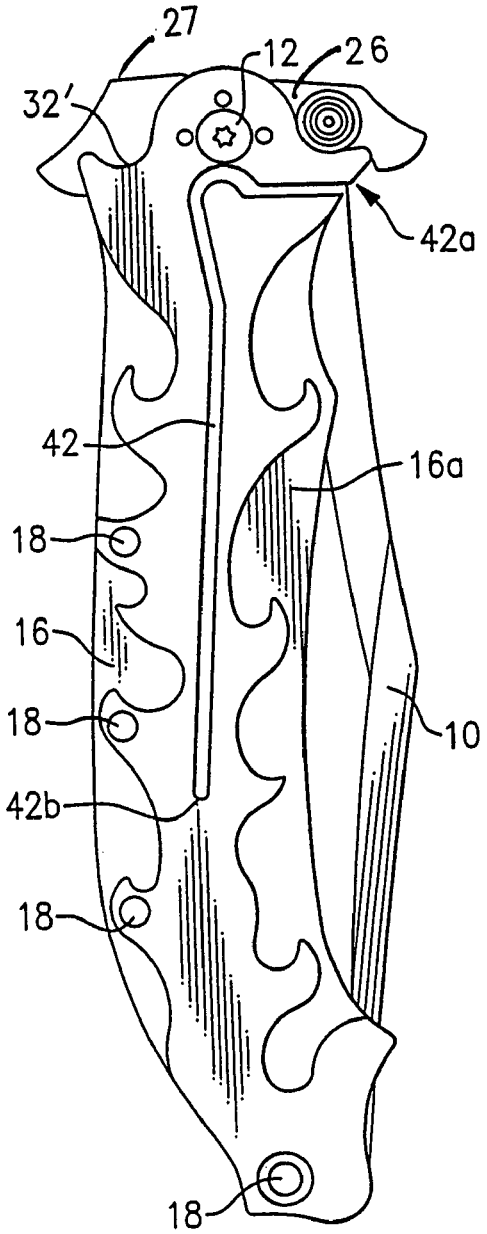
FIG. 8 is a side view of the side of the knife opposite the side shown in FIGS. 1 through 5, with the blade in the fully closed position.

The folding knife of the invention is shown in the fully closed position as seen from one side, termed the right side, in FIG. 1 and from the left side in FIG. 8. Blade 10 is mounted for pivotal movement about the central axis of pivot pin 12 with respect to the handle, consisting of right handle piece 14 (FIG. 1) and left handle piece 16 (FIG. 8). Handle pieces 14 and 16 are held in spaced relation by a plurality of threaded fasteners 18 and spacers 20 (FIG. 10). Thus, each of handle pieces 14 and 16 has an inwardly and an outwardly facing surface, the outwardly facing surfaces being seen in FIGS. 1 and 8, and the inwardly facing or opposed surfaces being seen in FIGS. 9 and 10. In the illustrated model, handle pieces 14 and 16 are constructed of metal and the outwardly facing surface of each is machined to provide a raised, decorative portion extending longitudinally along generally the central area, flanked on each side by outward surface portions where metal has been removed, although this is not considered any part of the inventive features of the knife. Blade 10 is provided with a sharpened edge 22, a point 24 at one end and integral tang 26 at the other end.

Figure 2:
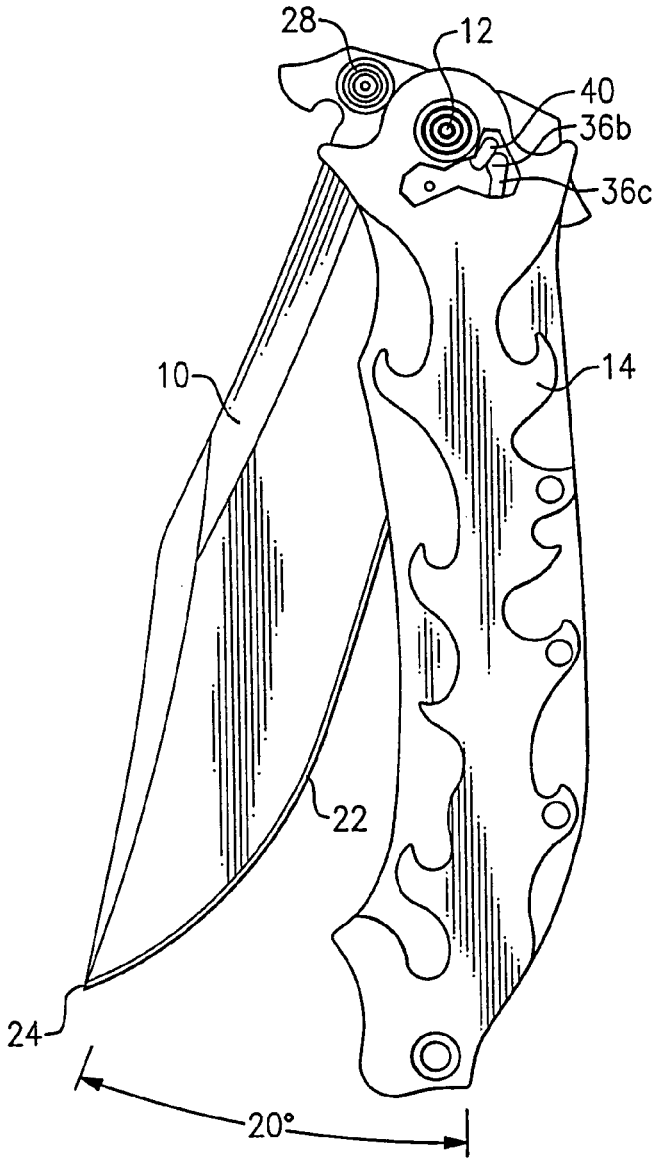
FIG. 2 is a fragmentary side view of the knife of FIG. 1 with the blade rotated about one-eighths of its travel away from the fully closed position.
Figure 3:
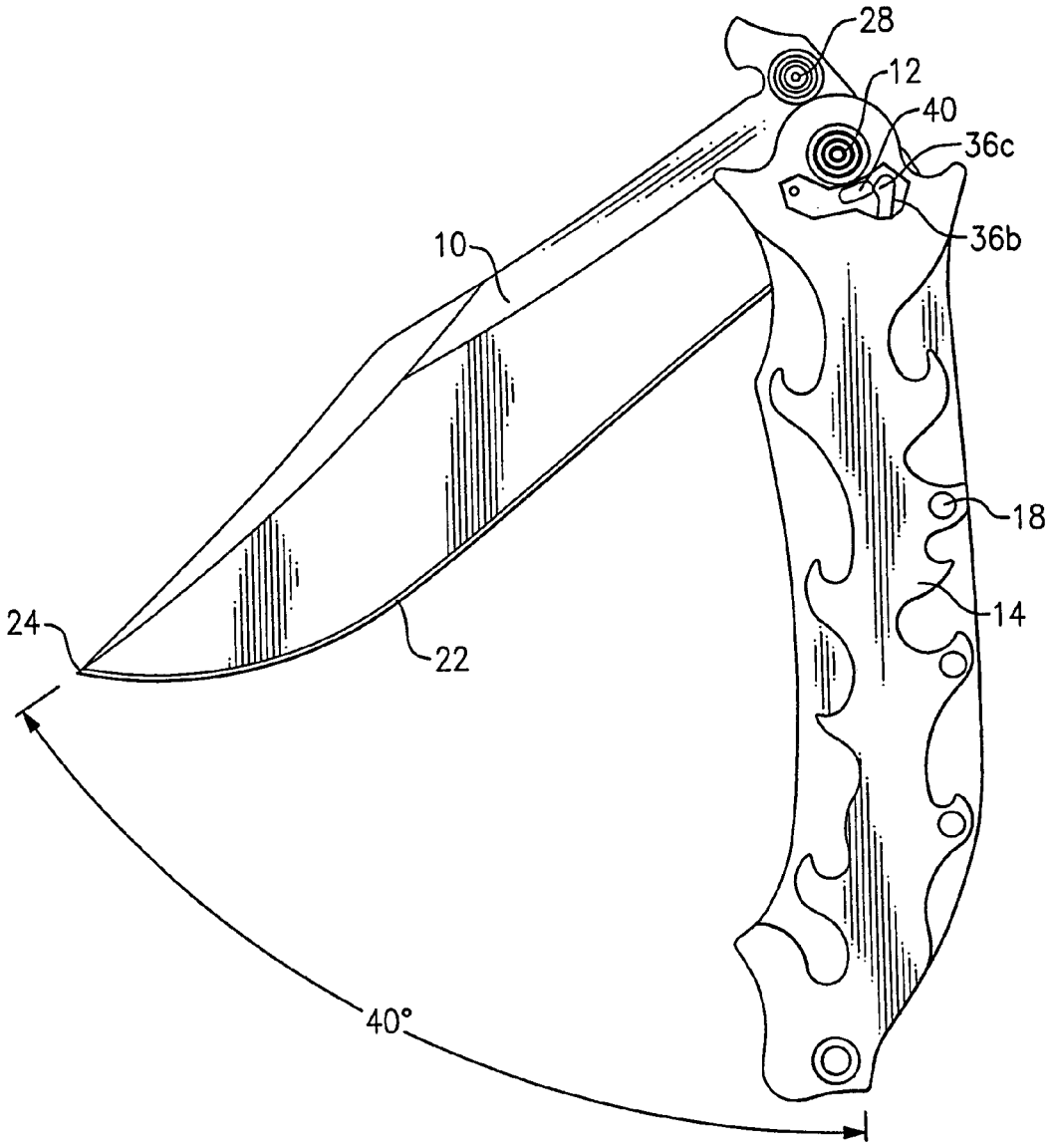
FIG. 3 is a fragmentary side view of the knife with the blade rotated about one-quarter of its travel away from the fully closed position.
Figures 4, 5:
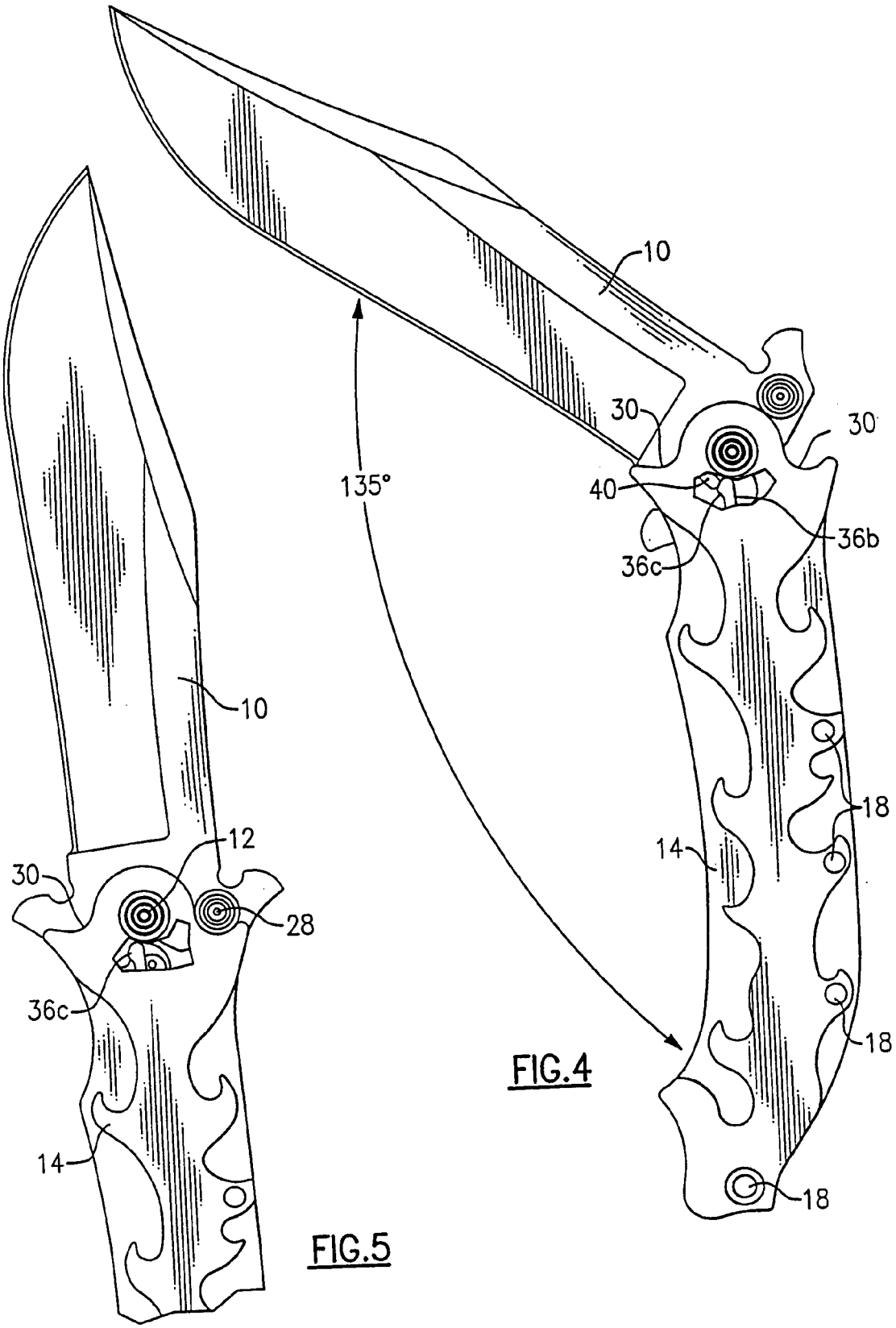
FIG. 4 is a fragmentary side view with the blade rotated through about three-quarters of its travel away from the fully closed position, or, conversely, one-quarter of its travel away from the fully closed position.
FIG. 5 is a fragmentary side view with the blade in its fully open position.
Figure 6:
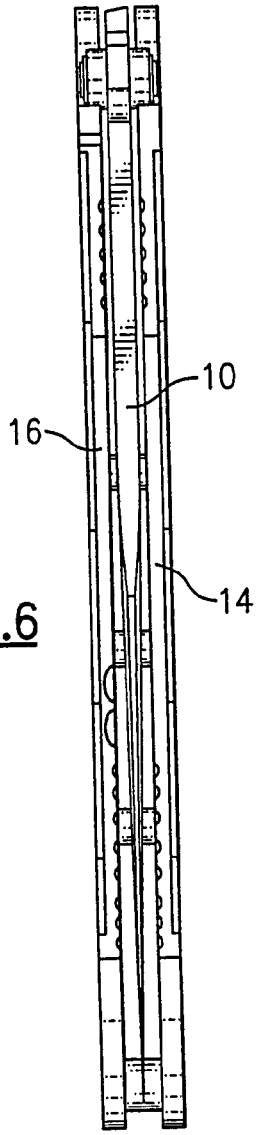
FIGS. 6 and 7 are top plan views of the knife with the blade in the closed and open positions, respectively.

In the fully closed position, a portion of blade 10 including edge 22 and point 24 is positioned in the space between handle pieces 14 and 16. Blade 10 is shown in FIG. 2 rotated about the axis of pin 12 to a position wherein the longitudinal axes of the blade and handle are disposed at an angle of about 20°. In FIGS. 3 and 4 the angle between the axes of the blade and handle are about 40° and 135°, respectively. The knife is shown in FIG. 5 with the blade in the fully open position, extending outwardly from the handle at the limit of its outward rotational travel, i.e., at an angle of 170° to 180°, depending on design preference. Limit pin 28 is affixed to tang 26, extending outwardly from opposite sides thereof. Curved surfaces 30, 30' are formed on handle piece 14 on opposite sides of pivot pin 12, and curved surfaces 32, 32' are formed on handle piece 16. One side of limit pin 28 contact surfaces 30 and 32 to define the fully closed position of blade 10, i.e., the limit of blade rotation in a counterclockwise direction as viewed in FIGS. 1–5. Likewise, the opposite side of limit pin 28 contacts surfaces 30' and 32' to limit clockwise rotation, thus defining the fully open position (FIG. 5) of the blade.

As seen in FIG. 10, a recess, indicated generally by referenced numeral 34, is formed in the inwardly facing surface of handle piece 14 and extends for most of the axial length thereof. Cantilever or beam spring 36 is positioned in recess 34, the spring preferably having a thickness substantially equal to the depth of the recess, whereby adjacent surfaces of the spring and handle piece are essentially coplanar. One end 36*a* of spring 36 is positioned in a portion of recess 34 having an outline corresponding to that of end 36*a* and one of threaded fasteners 18 passes through an opening in the spring to fixedly anchor end 36*a*. Free end 36*b* of spring 36 extends from recess 34 in handle piece 14; free end 36*b* includes lobe 36*c* on one side thereof. Cam pin 40 is affixed to tang 26 (or may be formed integrally therewith) and extends outwardly from one side thereof at a position spaced from (eccentric to) the axis of pivot pin 12. Thus, as blade 10 rotates between its closed and open positions, cam pin 40 travels arcuately about pivot pin 12. In the preferred embodiment, cam pin 40 has a pair of rounded ends with a lateral surface, i.e., the surface facing away from pivot pin 12, extending arcuately about the axis of the pivot pin. End 36*b* of spring 36 is in the path of movement of, and is contacted by, cam pin 40 over a portion of the rotational movement of blade 10, extending from the fully closed position of the blade to a position wherein the longitudinal axes of the blade and handle are disposed at an angle of about 135°. In the closed position, and throughout movement of the blade between the closed position and the aforesaid 135° angle, the lateral surface of cam pin 40 contacts lobe 36*c* of spring 36. The dimensions and position of cam pin 40 relative to lobe 36*c* are such that spring 36 is flexed away from a rest (unflexed) position, and thus exerts a biasing force on blade 10, throughout this range of rotation. In the views of FIGS. 1–4, lobe 36*c* is contacted by cam pin 40 with end 36*b* flexed toward the right from the rest position, and as shown in FIG. 5, the cam pin is not in contact with lobe 36*c* (when blade 10 is in its fully open position).

In the fully closed (FIG. 1) position, lobe 36*c* contacts cam pin 40 at one of its ends, wherein spring 36 exerts a force on cam pin 40 tending to rotate blade 10 in a counterclockwise direction about pivot pin 12. Limit pin 28 contacts curved surfaces 30 and 32 of handle pieces 14 and 16, respectively, to limit the extent of counterclockwise movement. That is, the closed position of blade 10 is defined by contact of pin 28 with portions of the handle and spring 36 acting upon cam pin 40 to maintain the blade in this position until a manual force is applied to move the blade in a clockwise direction, as viewed in FIGS. 1–5. After a few degrees of clockwise rotation, the manual force required to overcome the biasing force of spring 36 in the counterclockwise rotation is removed by the change in relative positions of spring lobe 36*c* and cam pin 40. As seen in FIG. 2, lobe 36*c* now contacts the lateral surface of cam pin 40, and the biasing force of spring 36 is directed upon cam pin 40 in a direction extending substantially through the axis of pivot pin 12. Therefore, blade 10 may be moved in either direction over a certain range, e.g., between about 20° and 40° by only such manual force as is required to overcome friction of the parts. When the blade reaches the position of FIG. 3, cam pin 40 has rotated to a position wherein lobe 36*c* contacts its other end (i.e., the end opposite that contacted when the blade is in the fully closed position, as previously described) and the force of spring 36 tends to rotate blade 10 in the clockwise direction. With no further manual force applied to blade 10, spring 36 will rapidly rotate the blade from the position of FIG. 3 to that of FIG. 4. Clockwise rotation beyond this point removes cam pin 40 from contact with any portion of spring 36. However, the energy transmitted by spring 36 to blade 10 during movement from the FIG. 3 to the FIG. 4 position is such that the momentum or inertia of the blade is sufficient to move the blade to the fully open position.

Figure 7:
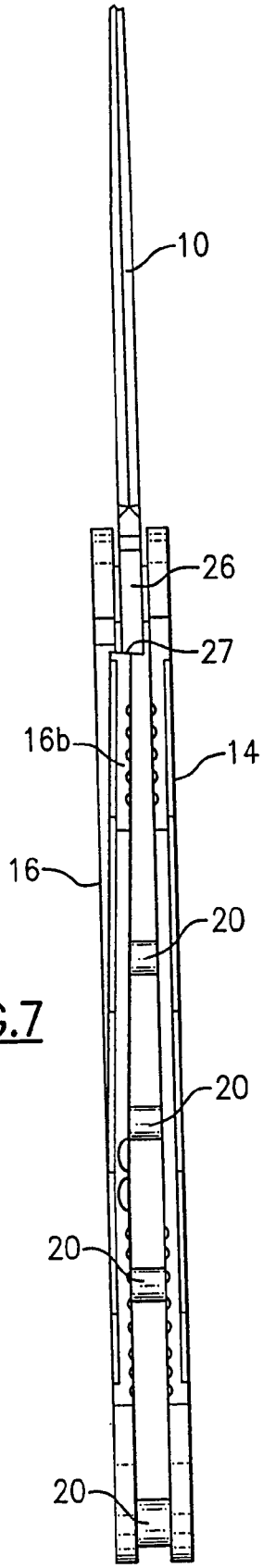
Figure 9:
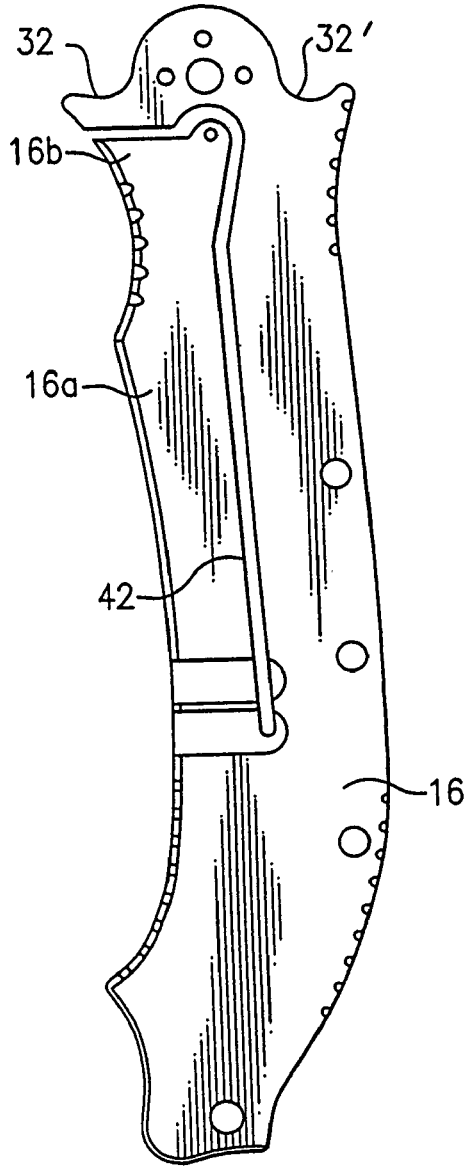
FIG. 9 is a side view of the side opposite FIG. 8 with portions removed.
Figure 10:
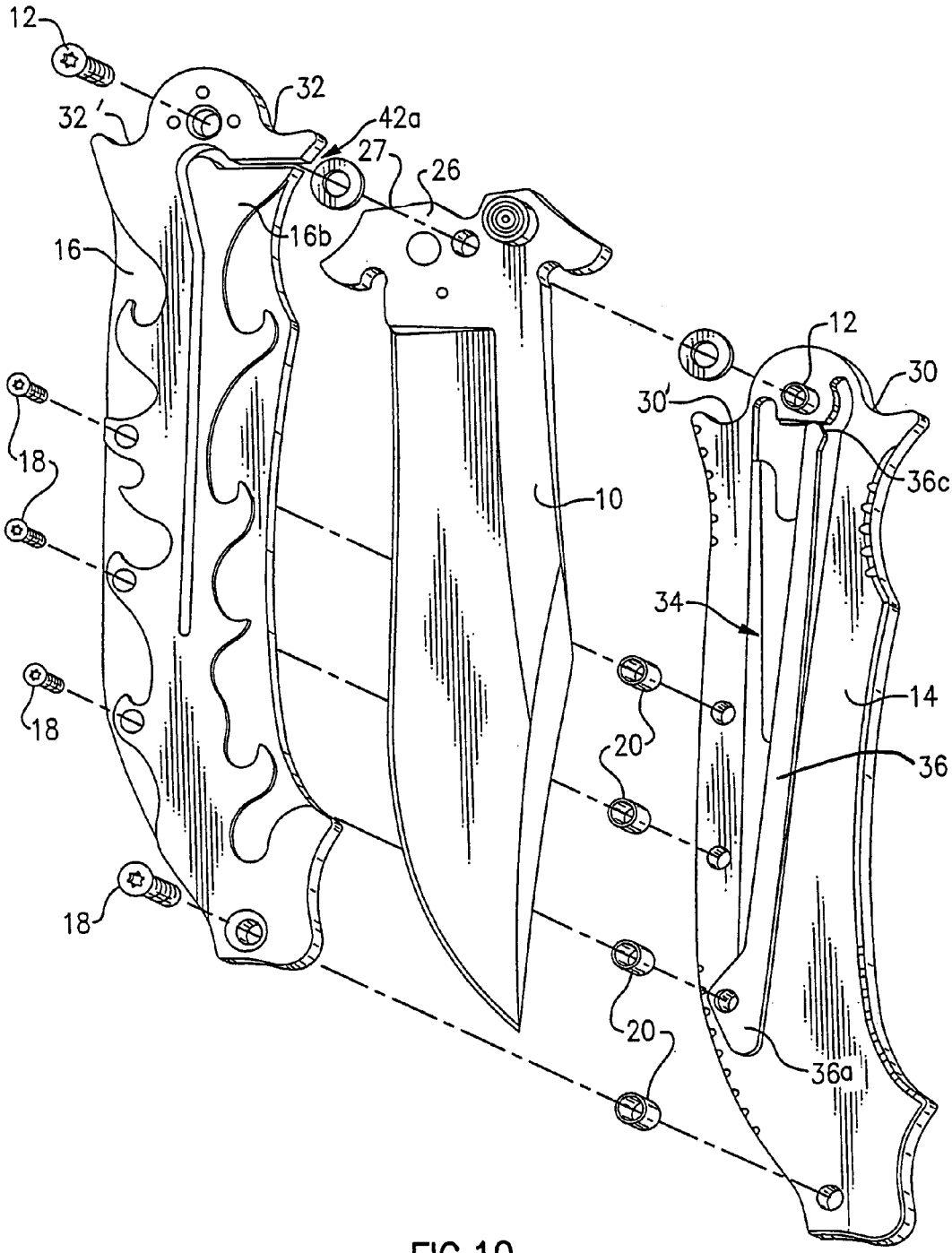
FIG. 10 is an exploded perspective view.
Figure 11:
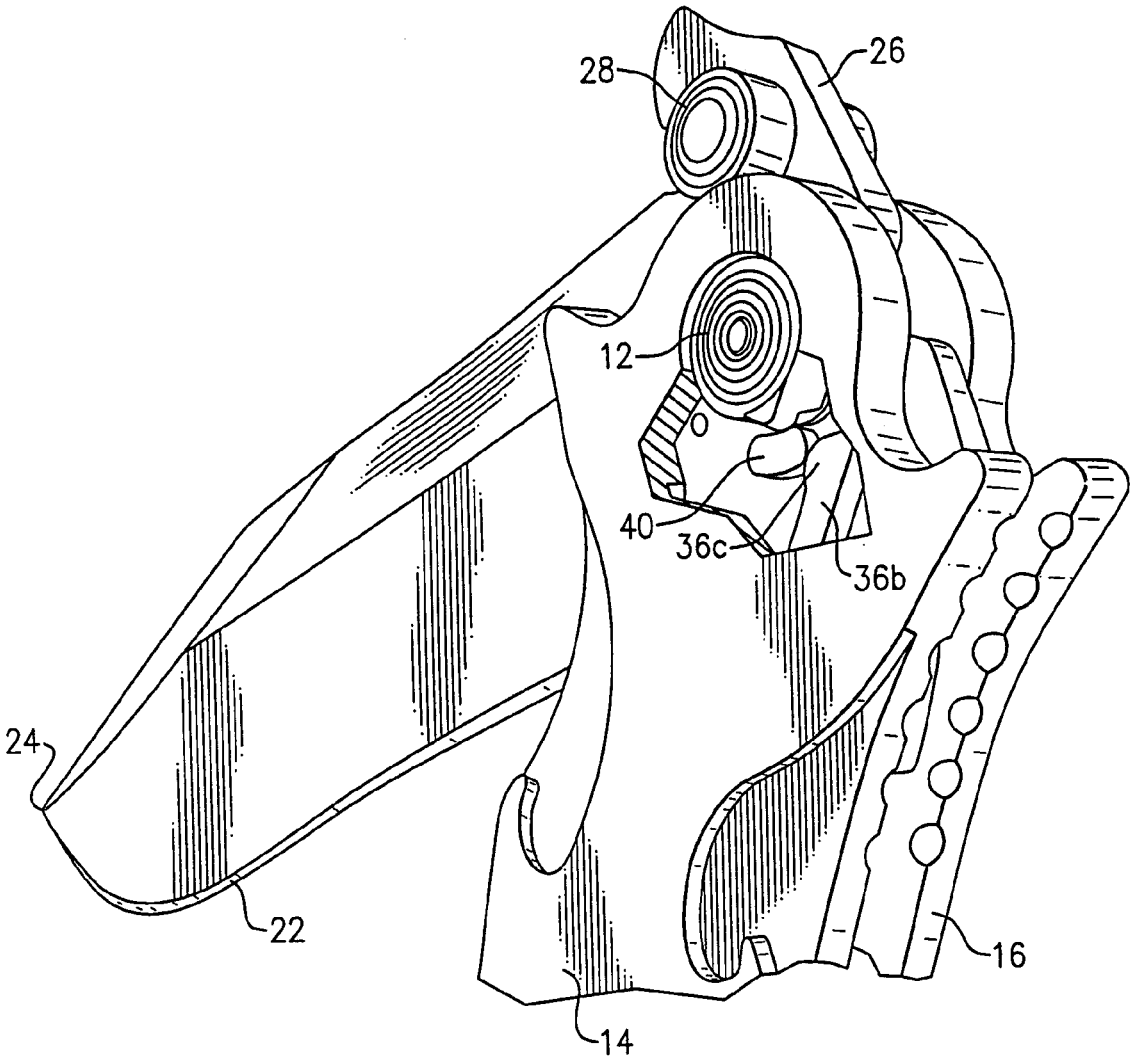
FIG. 11 is a fragmentary, perspective view of a portion of the knife with the blade in an intermediate position of travel.

In FIGS. 8–10 it will be noted that a through slot 42, having open and closed ends 42*a* and 42*b*, respectively, is cut in handle piece 16 to form portion 16*a*. A permanent bend is formed to place upper end 16*b* of portion 16*a* in a rest (unflexed) position laterally offset from the plane of the adjacent surface of the major portion of handle piece 16. When blade 10 is in any position other than fully open, end 16*b* is biased toward and contacts tang 26 on its side surface. When blade 10 reaches the fully open position, the biasing force moves end 16*b* laterally toward the right, as seen in FIG. 7, into abutting relation with an opposing surface portion 27 of tang 26. Thus, the fully open position of blade 10 is defined by contact of limit pin 28 with surfaces 30', 32 of the handle pieces and is locked in this position by contact of end 16*b* of handle portion 16*a* with portion 27 of tang 26. When it is desired to close the blade, end 16*b* may be moved laterally by the thumb of one hand until the blade has been rotated a short way from the fully open position, i.e., until the opposing surfaces of tang 26 and end 16*b* have been moved past one another. The blade may then be manually rotated against only frictional forces until cam pin 40 contacts lobe 36*b*, approximately at the FIG. 4 position, and thereafter rotated against the biasing force of spring 36 until it approaches the fully closed position, i.e., past the FIG. 2 position. Lobe 36*c* will contact the rounded end of cam pin 40 just prior to blade 10 reaching the fully closed position. Thus, while the biasing force of the cantilever spring assists in opening movement over a relatively large portion of blade movement, e.g., 75%, the biasing force in the closing movement is operative over only a relatively small, e.g., <10%, of the range of movement from fully open to fully closed. However, the biasing force does maintain the blade in the fully closed position until sufficient manual force is applied to overcome the biasing force.

What is claimed is:

1. In a folding knife having a handle portion and a blade mounted for pivotal movement about an axis adjacent to one end of said handle portion between a fully closed and a fully open position, means for assisting in movement of said blade to said open position, said assisting means comprising:

a) a tang portion formed integrally with said blade and through which said axis passes;

b) a camming member extending outwardly from said tang portion in a direction parallel to and spaced from said axis, said camming member including a camming surface having an arcuate portion substantially coaxial with said pivot axis that is eccentric relative to and extending between rounded ends movable through a predetermined path as said blade is moved about said axis; and c) a cantilever spring having a first end anchored to said handle portion, and a second, free end having a terminal portion positioned to engage said camming surface throughout at least a first portion of said predetermined path and to exert a biasing force urging said blade toward said fully open position over a second portion of said predetermined path.

2. The assisting means of claim 1 wherein said terminal portion comprises a lobe extending laterally from said free end.

3. The assisting means of claim 2 wherein said lobe contacts said camming surface when said blade is in said fully closed position.

4. The assisting means of claim 3 wherein said spring exerts a biasing force on said camming surface resiliently maintaining said blade in said fully closed position.

5. The assisting means of claim 4 wherein said second portion of said predetermined path forms a contiguous part of said first portion.

6. The assisting means of claim 1 wherein said camming surface and said terminal portion of said spring free end are so shaped and relatively positioned, that said first portion of said predetermined path is less than the full range of said predetermined path.

7. The assisting means of claim 6 wherein said first portion extends from the position of said camming surface when said blade is in said fully closed position over a majority of said full range of said predetermined path, said camming surface and said terminal portion being out of mutual contact over a third portion of said predetermined path extending from said first portion to the position of said camming surface when said blade is in said fully open position.

8. The assisting means of claim 7 wherein the biasing force imparted to said blade by said spring acting upon said camming surface is such that the momentum developed by said blade during unimpeded thereof through said second portion of said predetermined path is sufficient to move said blade to said fully open position throughout said third portion of said predetermined path.

9. The assisting means of claim 8 wherein said third portion of said predetermined path is between about 10% and about 40% of said full range of said predetermined path.

10. The assisting means of claim 9 wherein said second portion of said predetermined path is between about 10% and about 40% of said full range of said predetermined path.

11. A folding knife with spring assisted blade movement, said knife comprising:

a) a handle having a pair of spaced handle pieces and a longitudinal axis;

b) a blade having an integral tang pivotally mounted to said handle for movement with respect thereto about a pivot axis perpendicular to said longitudinal axis and extending through said handle pieces and said tang, between a fully closed position, wherein at least a portion of said blade is received between said handle pieces, and a fully open position, wherein said blade extends outwardly from said handle substantially along said longitudinal axis;

c) a camming member extending outwardly from said tang and movable therewith between first and second positions corresponding to said fully closed and fully open positions of said blade, respectively, said camming member having a camming surface including an arcuate portion substantially coaxial with said pivot axis that is eccentric relative to an extending between rounded ends and spaced outwardly from said pivot axis; and d) a cantilever spring having a first end portion fixedly attached to one of said handle pieces and a second, terminal end portion in mutual contact with said camming surface through a first portion of movement of said camming member extending from said first position for less than the full range of movement to said second position, said spring being out of contact with said camming surface through a second portion of movement of said camming member extending from the terminus of said first portion of movement of said camming member to said second position thereof.

12. A folding knife with spring assisted blade movement, said knife comprising:

a) a handle having a pair of spaced handle pieces and a longitudinal axis;

b) a blade having an integral tang pivotally mounted to said handle for movement with respect thereto about a pivot axis perpendicular to said longitudinal axis and extending through said handle pieces and said tang, between a fully closed position, wherein at least a portion of said blade is received between said handle pieces, and a fully open position, wherein said blade extends outwardly from said handle substantially along said longitudinal axis;

c) a camming member extending outwardly from said tang and movable therewith between first and second positions corresponding to said fully closed and fully open positions of said blade, respectively, said camming member having a camming surface spaced outwardly from said pivot axis;

d) a cantilever spring having a first end portion fixedly attached to one of said handle pieces and a second, terminal end portion in mutual contact with said camming surface through a first portion of movement of said camming member extending from said first position for less than the full range of movement to said second position, said spring being out of contact with said camming surface through a second portion of movement of said camming member extending from the terminus of said first portion of movement of said camming member to said second position thereof; and e) a stop member affixed to said tang at a position spaced from said pivot axis, and a pair of surface portions on at least one of said handle pieces, contact of said stop member with one of said surface portions defining the limit of movement of said blade toward said fully open position, and contact of said stop member with the other of said surface portions defining the limit of movement of said blade toward said fully closed position.

13. The knife of claim 12 wherein said stop member includes first and second portions extending outwardly from said tang portions on opposite sides thereof, and both of said handle pieces have a pair of said surface portions, said first and second portions of said stop member respectively contacting one of said surface portions of each of said handle pieces to define the limit of movement of said blade toward said fully open position, and contacting the other of said surface portions of each of said handle pieces to define the limit of movement of said blade toward said fully closed position.

14. The knife of claim 11 further including means for blocking movement of said blade away from said fully open position, said blocking means comprising portions of said tang and one of said handle pieces.

15. The knife of claim 11 wherein said first portion of movement of said camming member corresponds to rotation of said blade from said fully closed position through about 60% to about 90% of said camming member movement from said first to said second position.

16. A folding knife with spring assisted blade movement, said knife comprising:

a) a handle having a pair of spaced handle pieces and a longitudinal axis;

b) a blade having an integral tang pivotally mounted to said handle for movement with respect thereto about a pivot axis perpendicular to said longitudinal axis and extending through said handle pieces and said tang, between a fully closed position, wherein at least a portion of said blade is received between said handle pieces, and a fully open position, wherein said blade extends outwardly from said handle substantially along said longitudinal axis;

c) a camming member extending outwardly from said tang and movable therewith between first and second positions corresponding to said fully closed and fully open positions of said blade, respectively, said camming member having a camming surface spaced outwardly from said pivot axis; and d) a cantilever spring having a first end portion fixedly attached to one of said handle pieces and a second, terminal end portion in mutual contact with said camming surface through a first portion of movement of said camming member extending from said first position for less than the full range of movement to said second position, said spring being out of contact with said camming surface through a second portion of movement of said camming member extending from the terminus of said first portion of movement of said camming member to said second position thereof, wherein said handle pieces have spaced, opposing surfaces, and said one of said handle pieces has a cavity in said opposing surfaces thereof, a portion of said spring including said first end portion being contained within said cavity.

17. The knife of claim 16 wherein said cavity has a depth such that said spring and said opposing surface of said one of said handle pieces are substantially coplanar.

18. The knife of claim 17 wherein said one of said handle pieces has a through opening adjoining said cavity and wherein said spring extends from said cavity into said opening to said second end portion.

19. The knife of claim 18 wherein said second end portion includes a lobed portion contacting said camming surface throughout said first portion of movement of said camming member.

20. The knife of claim 19 wherein said terminal end portion of said spring contacts one of said rounded ends of said camming surface when said camming member is in said first position.

* * * * *